United States Patent [19]

Myers et al.

[11] 4,149,284

[45] Apr. 17, 1979

[54] APPARATUS FOR ISOLATING A BALL-COCK ASSEMBLY

[75] Inventors: Jasper N. Myers, Upland; Thomas Young, Rowland Heights, both of Calif.

[73] Assignee: Norris Industries, Inc., City of Industry, Calif.

[21] Appl. No.: 773,898

[22] Filed: Mar. 3, 1977

[51] Int. Cl.[2] ..... E03D 11/00

[52] U.S. Cl. ..... 4/353; 137/437

[58] Field of Search ..... 4/1, 18 R, 18 A, 353, 4/363; 137/437; 138/148, DIG. 6

[56] References Cited

U.S. PATENT DOCUMENTS

| | | | |
|---|---|---|---|
| 2,033,442 | 3/1936 | Morris | 4/18 R |
| 2,827,073 | 3/1958 | Owens | 137/437 |
| 3,495,630 | 2/1970 | Hansen et al. | 138/148 |
| 3,624,842 | 12/1971 | Harrison | 4/18 R |

*Primary Examiner*—Richard E. Aegerter
*Assistant Examiner*—L. Footland
*Attorney, Agent, or Firm*—Poms, Smith, Lande, Glenny & Rose

[57] ABSTRACT

An apparatus for isolating a ball-cock assembly locatable within a water closet flush tank from fluids contained within the flush tank has independent sleeve means of a material impervious to the fluid within the flush tank which is associated with a fluid riser of the ball-cock assembly and encloses the riser to provide a fluid-tight barrier between the riser and the fluid within the flush tank and mounting means for securing the sleeve means to the flush tank and providing a fluid-tight seal therebetween.

1 Claim, 5 Drawing Figures

APPARATUS FOR ISOLATING A BALL-COCK ASSEMBLY

BACKGROUND OF THE INVENTION

The present invention relates in general to flush tanks for holding fluid to flush an associated water closet. The level of fluid within the flush tank is controlled by means of a ball-cock assembly which is locatable within the flush tank. In particular, the present invention relates to devices for isolating the ball-cock assembly within the flush tank from the fluid contained within the flush tank.

Recent statutory developments in many jurisdictions require water closets having any portion of the tank below the flood level rim of the closet bowl to have the ball-cock assembly installed in a separate and isolated compartment of the tank, or other approved protection.

The purpose of the protective compartment is to prevent corrosion or impact fracturing of the ball-cock fluid riser at a point below the fluid level within the flush tank. Should the integrity of the fluid riser be breached below the fluid level in the flush tank, it would be possible for the fluid in the tank and the water closet bowl itself to back-syphon into the water supply line should there be any pressure loss within the supply line itself. This back-syphoning action would present the danger of contamination within the water supply system itself.

Prior art approaches to the problem of isolating a ball-cock assembly located within a water closet flush tank from the fluids contained within the flush tank have utilize integrally formed compartments within the flush tank itself. These integral compartments are formed of the same vitreous ceramic material as the flush tank itself during the casting of the tank.

It has been found in these prior art approaches that the cast chamber is an extremely expensive addition to the flush tank itself in that the casting molds required are more complex and the yield losses due to cracking and breaking during casting and firing of the tank are substantially higher than those incurred in the production of a plain tank without the integrally formed compartment. Additionally, should the integrally formed compartment damaged during installation of the plumbing fixture, it is impossible to be repaired on the construction site.

A further disadvantage in the prior art approaches is the expense of converting pre-existing plumbing to conform to the code provisions. Thus, stock-on-hand in plumbing supply stores may not be utilized in new construction due to the lack of protection for the ball-cock riser. Additionally, the expense of the intricate tanks requires a standardized ball-cock riser due to the lack of flexiblity and adaptability of the compartment cast within the tank.

SUMMARY OF THE INVENTION

It is therefore a primary object of the present invention to disclose and provide an improved apparatus for isolating a ball-cock assembly within a water closet flush tank from the fluids contained within the tank which does not require the use of a complex tank configuration and its attendant high cost and high production yield losses.

It is a further object of the present invention to disclose and provide an improved apparatus which may be added to existing flush tanks to provide the statutorily required isolation of the ball-cock fluid riser and which is economically repaired or replace if damaged.

It is a further object of the present invention to disclose and provide an improved isolation apparatus which is adaptable to various configurations of ball-cock fluid risers.

Generally stated, the present invention in an improved apparatus for isolating a ball-cock assembly located within a water closet flush tank from fluids contained within the tank includes the provision of sleeve means of a material impervious to the fluid within the flush tank which is independent of the flush tank and associated with the fluid riser of the ball-cock assembly and which encloses the fluid riser and provides a fluid-tight barrier between the fluid riser and the fluid within the flush tank. Mounting means are provided for securing the sleeve means to the flush tank and for providing a fluid-tight seal between the sleeve and the flush tank.

A more complete understanding of the improvements in an apparatus for isolating a ball-cock assembly locatable within a water closet flush tank from fluids contained within the flush tank in accordance with the present invention, as well as a recognition of additional objects and advantages therefor, will be afforded to those skilled in the art from a consideration of the following detailed description of an exemplary embodiment thereof. Reference will be made to the appended sheets of drawings which will first be discussed briefly.

DETAILED DESCRIPTION OF AN EXEMPLARY EMBODIMENT

Figure 1:
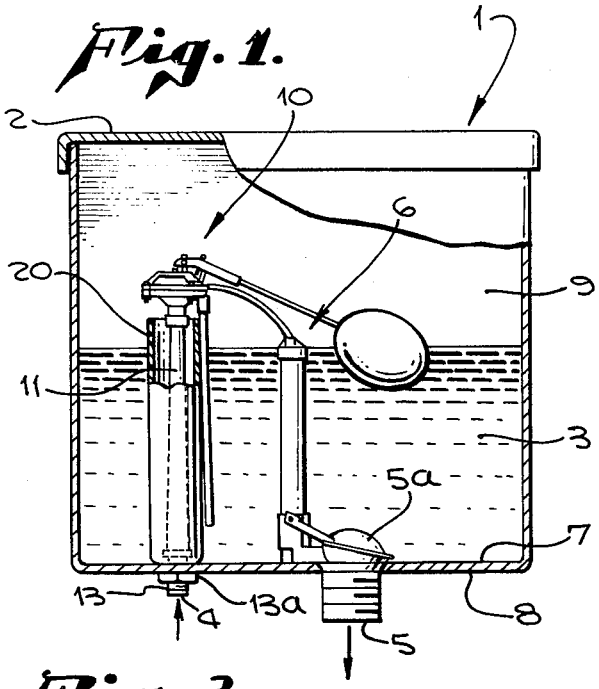
FIG. 1 shows the apparatus of the present invention installed within a water closet flush tank.

Referring first to FIG. 1, a water closet flush tank shown generally at 1 has a lid 2 and contains flushing fluid 3. An overflow port 6 limits the level of flushing fluid within the tank. To drain the tank, as during flushing the water closet, outlet cover 5*a* to fluid outlet 5 is raised by means of mechanical apparatus not shown. To re-fill the flush tank, flushing fluid 3 is allowed to flow through ball-cock assembly 10 into the tank.

Figure 2:
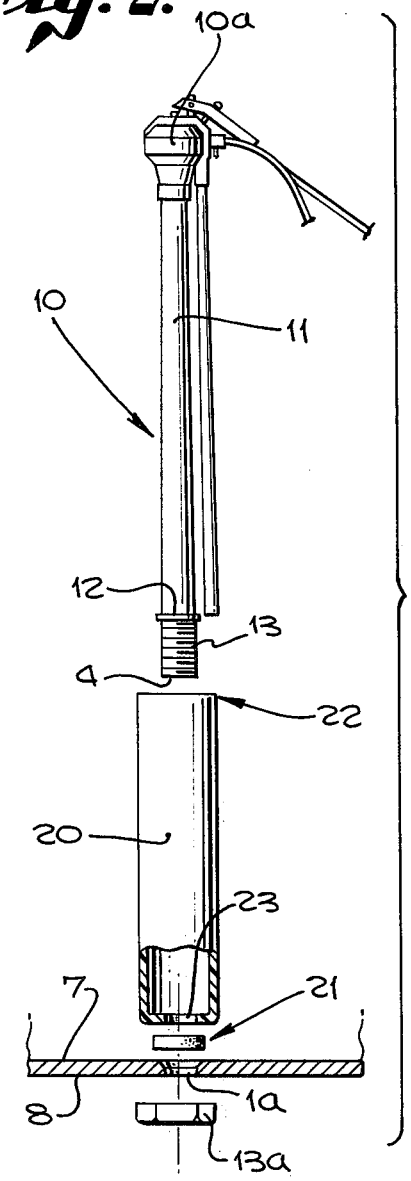
FIG. 2 is an exploded view showing the apparatus of the present invention and its relationship to a ball-cock assembly and the wall of the flush tank.

As may best be seen in FIGS. 1 and 2, ball-cock assembly 10 has a fluid riser 11 which is provided with a riser flange 12 and a riser shank 13 which terminates at fluid inlet 4. Flushing fluid is introduced through fluid inlet 4 flows through fluid riser 11 to the ball-cock valve shown generally at 10*a* which controls the flow of flushing fluid into the flush tank.

In order to isolate the ball-cock assembly 10 which is located within water closet flush tank 1 from the flushing fluid 3 contained within the flush tank, sleeve means 20 independent of the flush tank and associated with fluid riser 11 of ball-cock assembly 10 encloses fluid riser 11 and provides a fluid-tight barrier between fluid riser 11 flushing fluid 3 within flush tank 1. Mounting means secure sleeve means 20 to 10 flush tank 1 and provide a fluid-tight seal therebetween as may best be seen in FIGS. 1 and 5.

Figure 3:
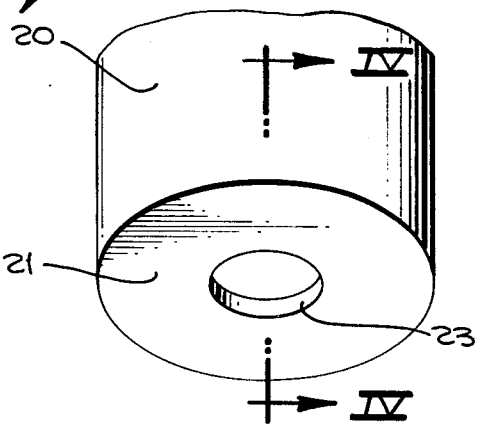
FIG. 3 is a perspective view of the sleeve means of the present invention.
Figure 4:
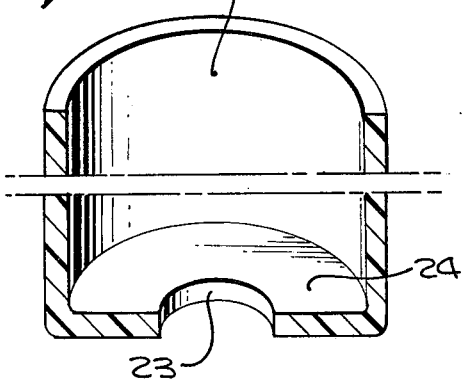
FIG. 4 is a perspective sectional view through the plane IV—IV of FIG. 3.

As is best seen in FIGS. 2, 3 and 4, sleeve means 20 is a tubular sleeve. To practice the present invention, the tubular sleeve may be fabricated from any suitable non-porous material which is impervious to the flushing fluid within flush tank 1. Exemplary of such materials would be polypropylene, bakelite, glass or ceramic. Tubular sleeve 20 is at least partially closed at a first end 21 which is mountable to internal surface 7 of flush tank 1. Tubular sleeve 20 is of a sufficient length to allow a second end 22 of tubular sleeve 20 to extend to a position of a pre-selectable distance above fluid overflow port 6 of flush tank 1 which controls the level of flushing fluid within the tank.

Figure 5:
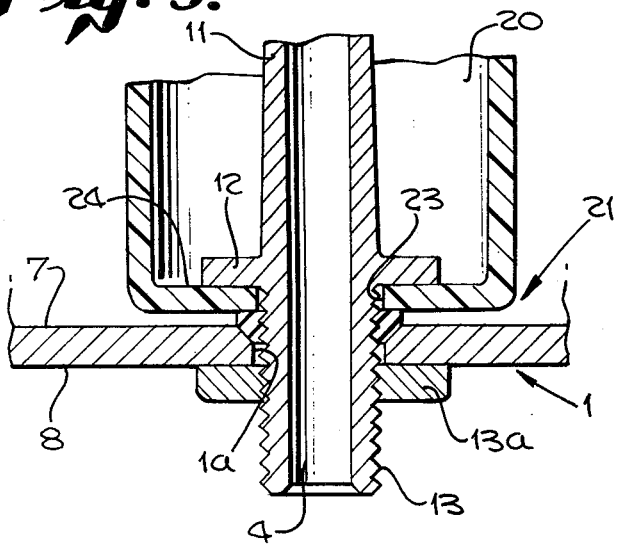
FIG. 5 is a sectional view through the plane V—V of FIG. 1 showing in detail the interrelationship between the flush tank wall, the fluid riser and the tubular sleeve of the present invention.

Referring to FIGS. 1, 2 and 5, it should be noted that tubular sleeve 20 is at least partially open at second end 22 to expose riser 11 to an ambient atmosphere above the level of flushing fluid within the flush tank. This provides for circulation of the ambient atmosphere about fluid riser 11 within tubular sleeve 20.

To seal tubular sleeve 20, riser shank 13 and flush tank 1 and to prevent the leakage of flushing fluid therebetween, sealing means are provided. An aperture 23 extends through partially closed end 21 of tubular sleeve 20 to allow shank portion 13 of fluid riser 11 to extend through the tubular sleeve. Fluid riser 11 is placed inside tubular sleeve 20, riser shank 13 is extended through aperture 23 and an abuttment 24 defined by internal surface 21*a* of tubular sleeve 20 engages a riser flange 12 of fluid riser 11 and limits movement of riser shank 13 through aperture 23. A deformable seal 14, such as a rubber washer, external of and adjacent to tubular sleeve 20 receives riser shank 13 of fluid riser 11. Riser shank 13 is then inserted through aperture 1*a* in flush tank 1 and means 13*a*, such as a lock-nut accessible through aperture 1*a* in flush tank 1 receives riser shank 13 and draws riser shank 13 through aperture 1*a*. As riser shank 13 is drawn through aperture 1*a*, riser flange 12 contacts abuttment 24 within tubular sleeve 20 and draws tubular sleeve 20 toward the wall of flush tank 1. Deformable seal 14 is compressibly deformed between the external surface of partially closed end 21 of tubular sleeve 20 and internal surface 7 of flush tank. The compression of deformable seal 14 between partially closed end 21 of tubular sleeve 20 and internal surface 7 of flush tank 1 provides a fluid-tight seal between tubular sleeve 20, riser shank 13 and flush tank 1 when tightening means 13*a* is secured.

Thus, it may be seen that a separate and isolated compartment which is independent of and removable from flush tank 1 is provided within flush tank 1 to receive fluid riser 11 of ball-cock assembly 10 and isolated ball-cock assembly 10 from flushing fluids contained within flush tank 1.

Having thus described an exemplary embodiment of an improved apparatus for isolating a ball-cock assembly locatable within a water closet flush tank from flushing fluids contained within the flush tank, it should be understood by those skilled in the art that various alternatives and modifications thereof may be made within the scope and spirit of the present invention which is defined by the following claims.

We claim:

1. In an apparatus for isolating a ball-cock assembly comprising a fluid riser having a shank portion at a first end thereof and having a second end interconnected to a ball-cock valve, said ball-cock assembly being locatable within a water closet flush tank, from fluids contained within said flush tank, the improvement comprising:

sleeve means independent of said flush tank for enclosing said riser and providing a fluid-tight barrier between said riser and said fluid within said flush tank, wherein said sleeve means comprises a tubular sleeve impervious to said fluid and at least partially closed at a first end which is mountable to an internal surface of said flush tank and having a second end which extends to a position of a pre-selectable distance above a fluid overflow port of said flush tank; and mounting means for securing said sleeve means to said flush tank and providing a fluid-tight seal therebetween including sealing means comprising a riser flange intermediate to the ends of said fluid riser, an aperture extending through said partially closed end of said sleeve means for allowing said shank portion of said fluid riser to extend therethrough, an abutment defined by an internal surface of said sleeve means for engaging said riser flange and limiting movement of said shank through said aperture, tightening means accessible through an aperture in said flush tank for receiving said shank portion of said fluid riser and drawing said shank portion of said fluid riser through said aperture in said flush tank and securing said fluid riser to said flush tank, and a deformable seal external of and adjacent to said sleeve means for receiving said shank portion of said fluid riser and compressively deforming between said sleeve means and an internal surface of said flush tank for providing a fluid-tight seal between said sleeve means, said shank portion of said riser and said flush tank when said tightening means is secured.

* * * * *